US011351775B2

(12) United States Patent
Linn et al.

(10) Patent No.: US 11,351,775 B2
(45) Date of Patent: Jun. 7, 2022

(54) INTEGRATED CIRCUITS INCLUDING CUSTOMIZATION BITS

(71) Applicant: HEWLETT-PACKARD DEVELOPMENT COMPANY, L.P., Spring, TX (US)

(72) Inventors: Scott A. Linn, Corvallis, OR (US); James Michael Gardner, Corvallis, OR (US); Michael W. Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 51 days.

(21) Appl. No.: 16/957,517

(22) PCT Filed: Feb. 6, 2019

(86) PCT No.: PCT/US2019/016884
§ 371 (c)(1),
(2) Date: Jun. 24, 2020

(87) PCT Pub. No.: WO2020/162931
PCT Pub. Date: Aug. 13, 2020

(65) Prior Publication Data

US 2021/0229426 A1 Jul. 29, 2021

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC . B41J 2/04541; B41J 2/17546; B41J 2/04586
See application file for complete search history.

(56) References Cited

U.S. PATENT DOCUMENTS

| | | | | |
|---|---|---|---|---|
| 6,193,342 | B1 * | 2/2001 | Suzuki | B41J 2/04541 347/9 |
| 8,199,342 | B2 | 6/2012 | Martin | |
| 8,864,260 | B1 | 10/2014 | Ge et al. | |
| 9,573,362 | B2 | 2/2017 | Ono et al. | |
| 9,764,562 | B2 | 9/2017 | Suzuki et al. | |
| 9,981,465 | B1 | 5/2018 | Mu et al. | |
| 10,118,387 | B2 | 11/2018 | Bakker et al. | |
| 2001/0019343 | A1 | 9/2001 | Walker | |

FOREIGN PATENT DOCUMENTS

| | | | |
|---|---|---|---|
| EP | 1156489 | B1 | 12/2004 |
| JP | 2016093896 | A | 5/2016 |
| WO | WO-2016068833 | A1 | 5/2016 |
| WO | WO-2017058125 | A2 | 4/2017 |

* cited by examiner

*Primary Examiner* — Lam S Nguyen
(74) *Attorney, Agent, or Firm* — Dicke Billig & Czaja PLLC

(57) ABSTRACT

An integrated circuit to drive a plurality of fluid actuation devices includes a plurality of first memory cells, a plurality of first storage elements, and control logic. Each first memory cell stores a customization bit. Each first storage element is coupled to a corresponding first memory cell. The control logic, in response to a reset signal, reads the customization bit stored in each first memory cell and latches each customization bit in a corresponding first storage element.

15 Claims, 8 Drawing Sheets

INTEGRATED CIRCUITS INCLUDING CUSTOMIZATION BITS

CROSS-REFERENCE TO RELATED APPLICATIONS

This application is a U.S. National Stage Application of PCT Application No. PCT/US2019/016884, filed Feb. 6, 2019, entitled "INTEGRATED CIRCUITS INCLUDING CUSTOMIZATION BITS".

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

There may be advantages to having an integrated circuit (e.g., a semiconductor die) behave differently for various geographic regions, for subscription or non-subscription customers, or for other reasons. Rather than fabricate multiple physical integrated circuits designed to behave differently that may have to be tracked individually or managed separately, it may be easier to write some non-volatile memory bits to an integrated circuit (e.g., during manufacturing) to change the behavior of the integrated circuit.

Accordingly, disclosed herein are integrated circuits (e.g., fluid ejection dies) including a plurality of memory cells each storing a customization bit and one memory cell storing a lock bit. The integrated circuits also include a storage element (e.g., latch) coupled to each of the memory cells. When a reset signal is applied to the integrated circuit, the memory cells are internally read and the customization bits and the lock bit are latched by the storage elements. After reset, the latched customization bits and the lock bit may be used to control operations of the integrated circuit. The latched lock bit may allow or prevent write access and external read access to the memory cells and/or allow or prevent other operations of the integrated circuit. The customization bits may be used to modify an address input to the integrated circuit or to modify other operations of the integrated circuit.

As used herein a "logic high" signal is a logic "1" or "on" signal or a signal having a voltage about equal to the logic power supplied to an integrated circuit (e.g., between about 1.8 V and 15 V, such as 5.6 V). As used herein a "logic low" signal is a logic "0" or "off" signal or a signal having a voltage about equal to a logic power ground return for the logic power supplied to the integrated circuit (e.g., about 0 V).

Figure 1A:
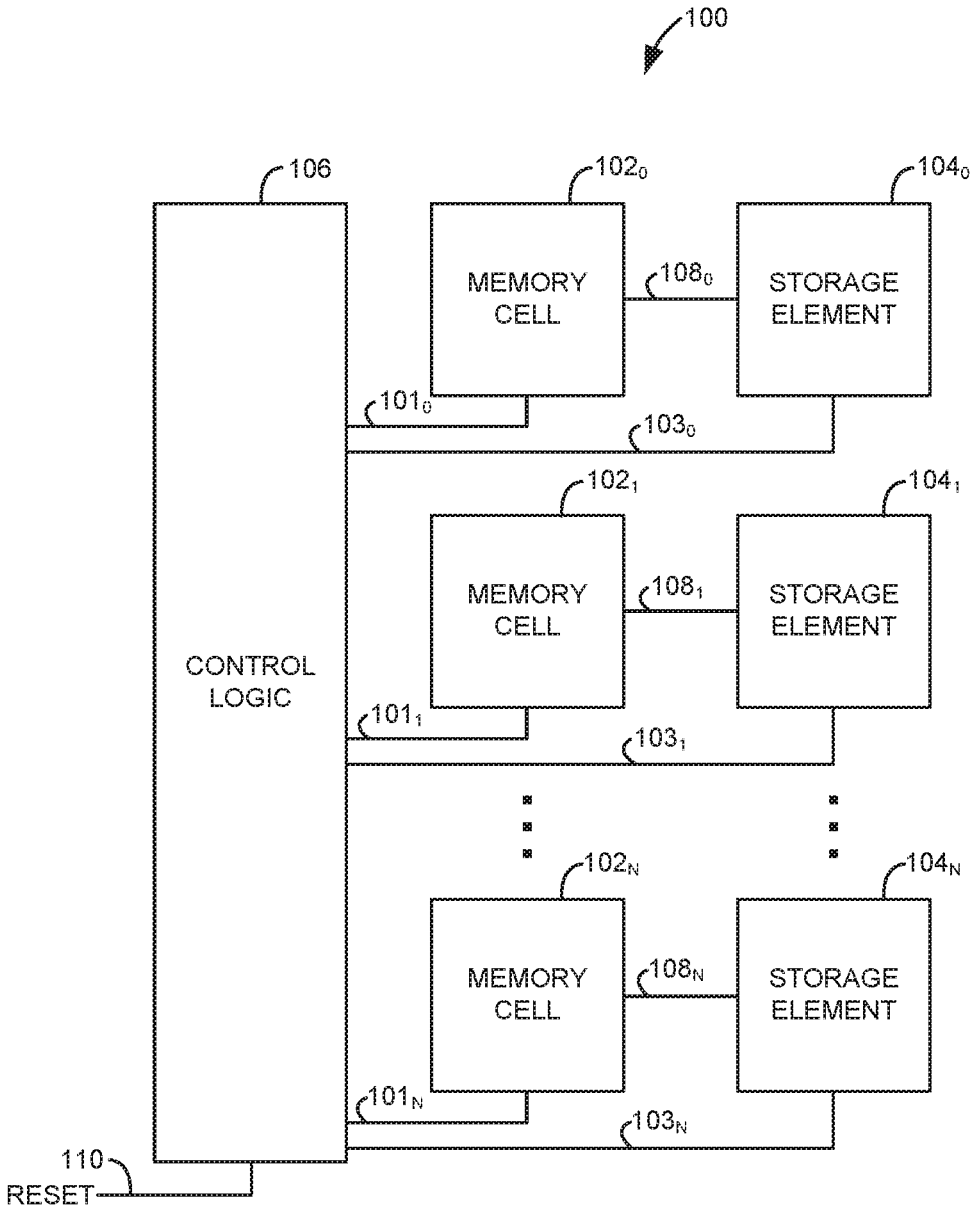
FIG. 1A is a block diagram illustrating one example of an integrated circuit to drive a plurality of fluid actuation devices.

FIG. 1A is a block diagram illustrating one example of an integrated circuit 100 to drive a plurality of fluid actuation devices. Integrated circuit 100 includes a plurality of first memory cells $\mathbf{102}_0$ to $\mathbf{102}_N$, where "N" is any suitable number of memory cells (e.g., four memory cells). Integrated circuit 100 also includes a plurality of first storage elements $\mathbf{104}_0$ to $\mathbf{104}_N$, and control logic 106. Control logic 106 is electrically coupled to each first memory cell $\mathbf{102}_0$ to $\mathbf{102}_N$ through a signal path $\mathbf{101}_0$ to $\mathbf{101}_N$, respectively, to each first storage element $\mathbf{104}_0$ to $\mathbf{104}_N$ through a signal path $\mathbf{103}_0$ to $\mathbf{103}_N$, respectively, and to a reset signal path 110. Each first memory cell $\mathbf{102}_0$ to $\mathbf{102}_N$ is electrically coupled to a corresponding first storage element $\mathbf{104}_0$ to $\mathbf{104}_N$ through a signal path $\mathbf{108}_0$ to $\mathbf{108}_N$, respectively.

The reset signal path 110 may be electrically coupled to a reset interface, which may be a contact pad, a pin, a bump, a wire, or another suitable electrical interface for transmitting signals to and/or from integrated circuit 100. The reset interface may be electrically coupled to a fluid ejection system (e.g., a host print apparatus such as fluid ejection system 600, which will be described below with reference to FIG. 6).

Each first memory cell $\mathbf{102}_0$ to $\mathbf{102}_N$ stores a customization bit. Each first memory cell $\mathbf{102}_0$ to $\mathbf{102}_N$ includes a non-volatile memory cell (e.g., a floating gate transistor, a programmable fuse, etc.). Each first storage element $\mathbf{104}_0$ to $\mathbf{104}_N$ includes a latch or another suitable circuit that outputs a logic signal (i.e., a logic high signal or a logic low signal) that may be directly used by digital logic. Control logic 106 may include a microprocessor, an application-specific integrated circuit (ASIC), or other suitable logic circuitry for controlling the operation of integrated circuit 100.

Control logic 106, in response to a reset signal on reset signal path 110, reads (e.g., in response to a first edge of the reset signal) the customization bit stored in each first memory cell $\mathbf{102}_0$ to $\mathbf{102}_N$ and latches (e.g., in response to a second edge of the reset signal) each customization bit in a corresponding first storage element $104_0$ to $104_N$. In one example, control logic 106 configures an operation of integrated circuit 100 based on the latched customization bits. In one example, the operation may modify an address input to the integrated 100 based on the latched customization bits. In other examples, other operations of integrated circuit 100 may be modified based on the latched customization bits.

Figure 1B:
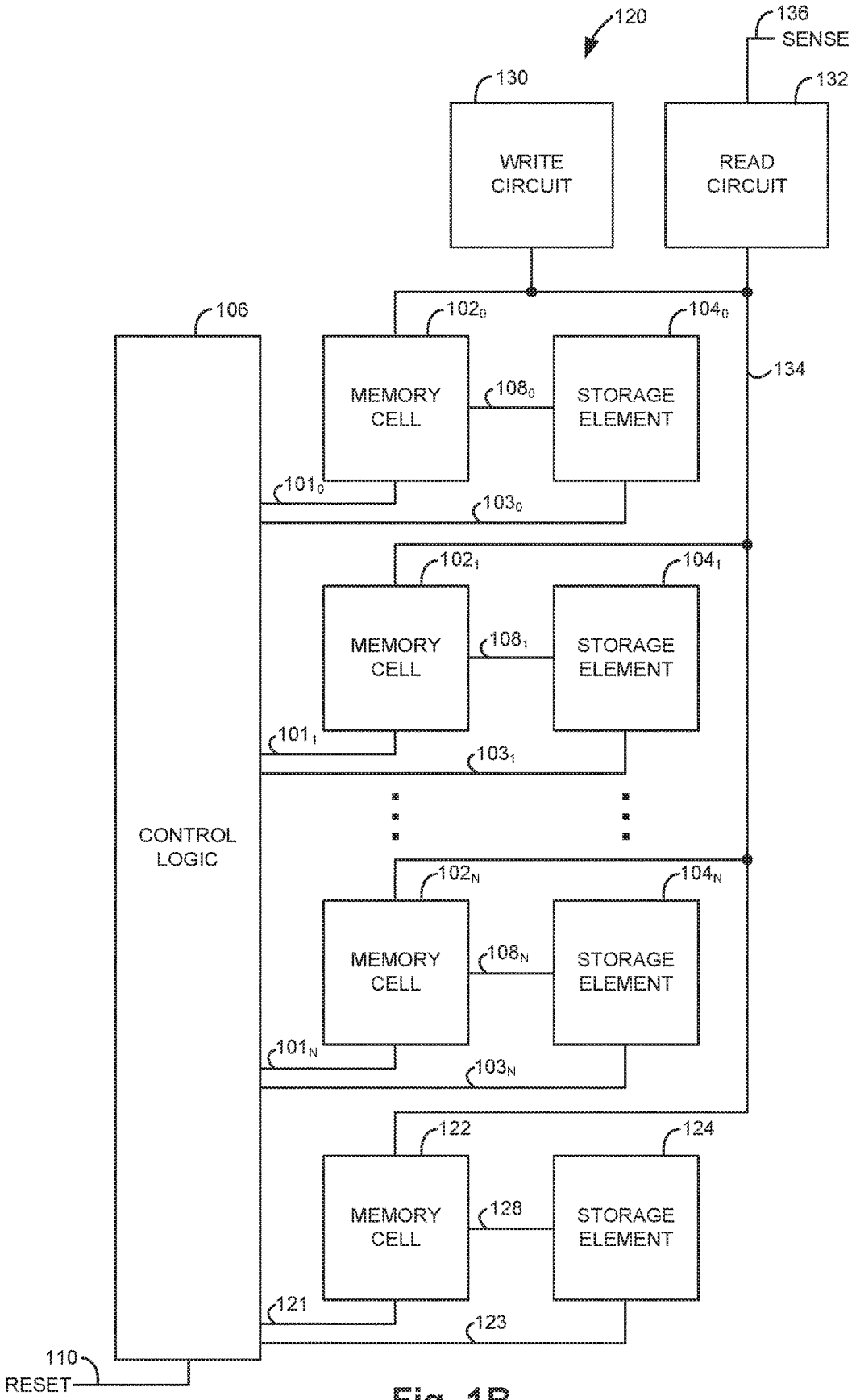
FIG. 1B is a block diagram illustrating another example of an integrated circuit to drive a plurality of fluid actuation devices.

FIG. 1B is a block diagram illustrating another example of an integrated circuit 120 to drive a plurality of fluid actuation devices. Integrated circuit 120 includes a plurality of first memory cells $102_0$ to $102_N$, a plurality of first storage elements $104_0$ to $104_N$, and control logic 106. In addition, integrated circuit 120 includes a second memory cell 122, a second storage element 124, a write circuit 130, and a read circuit 132. Control logic 106 is electrically coupled to second memory cell 122 through a signal path 121 and to storage element 124 through a signal path 123. The second memory cell 122 is electrically coupled to the storage element 124 through a signal path 128. Each first memory cell $102_0$ to $102_N$, the second memory cell 122, the write circuit 130, and the read circuit 132 are electrically coupled to a single interface (e.g., a single wire) 134. Read circuit 132 is electrically coupled to an interface (e.g., sense interface) 136.

The sense interface 136 may be a contact pad, a pin, a bump, a wire, or another suitable electrical interface for transmitting signals to and/or from integrated circuit 120. The sense interface 136 may be electrically coupled to a fluid ejection system (e.g., a host print apparatus such as fluid ejection system 600 of FIG. 6).

The second memory cell 122 stores a lock bit. The second memory cell 122 includes a non-volatile memory cell (e.g., a floating gate transistor, a programmable fuse, etc.). The second storage element 124 includes a latch or another suitable circuit that outputs a logic signal (i.e., a logic high signal or a logic low signal) that may be directly used by digital logic. Control logic 106, in response to the reset signal, reads (e.g., in response to a first edge of the reset signal) the lock bit stored in the second memory cell 122 and latches (e.g., in response to a second edge of the reset signal) the lock bit in the second storage element 124. In addition, control logic 106 allows or prevents writing to the plurality of first memory cells $102_0$ to $102_N$ based on the latched lock bit. In one example, control logic 106 also allows or prevents writing to the second memory cell 122 based on the latched lock bit. For example, if a "0" lock bit is stored in the second memory cell 122, the customization bits stored in first memory cells $102_0$ to $102_N$ may be modified. Once a "1" lock bit is written to second memory cell 122, the customization bits stored in first memory cells $102_0$ to $102_N$ cannot be modified and the lock bit stored in the second memory cell 122 cannot be modified.

The write circuit 130 writes the corresponding customization bit to each of the plurality of first memory cells $102_0$ to $102_N$ through the single interface 134. The write circuit 130 may also write the lock bit to the second memory cell 122 through the single interface 134. In one example, write circuit 130 may include a voltage regulator and/or other suitable logic circuitry for writing customization bits to first memory cells $102_0$ to $102_N$ and the lock bit to second memory cell 122.

The read circuit 132 enables external access (e.g., via sense interface 136) to read the customization bit of each of the plurality of first memory cells $102_0$ to $102_N$ through the single interface 134. The read circuit 132 may also enable external access (e.g., via sense interface 136) to read the lock bit of the second memory cell 122 through the single interface 134. In one example, read circuit 132 may include transistor switches or other suitable logic circuitry for enabling external read access to first memory cells $102_0$ to $102_N$ and second memory cell 122 through sense interface 136. In one example, control logic 106 allows or prevents external read access to the plurality of first memory cells $102_0$ to $102_N$ and to second memory cell 122 based on the latched lock bit. For example, if a "0" lock bit is stored in the second memory cell 122, the customization bits stored in first memory cells $102_0$ to $102_N$ and the lock bit stored in the second memory cell 122 may be read through read circuit 132. Once a "1" lock bit is written to second memory cell 122, the customization bits stored in first memory cells $102_0$ to $102_N$ and the lock bit stored in the second memory cell 122 cannot be read through read circuit 132.

Figure 2:
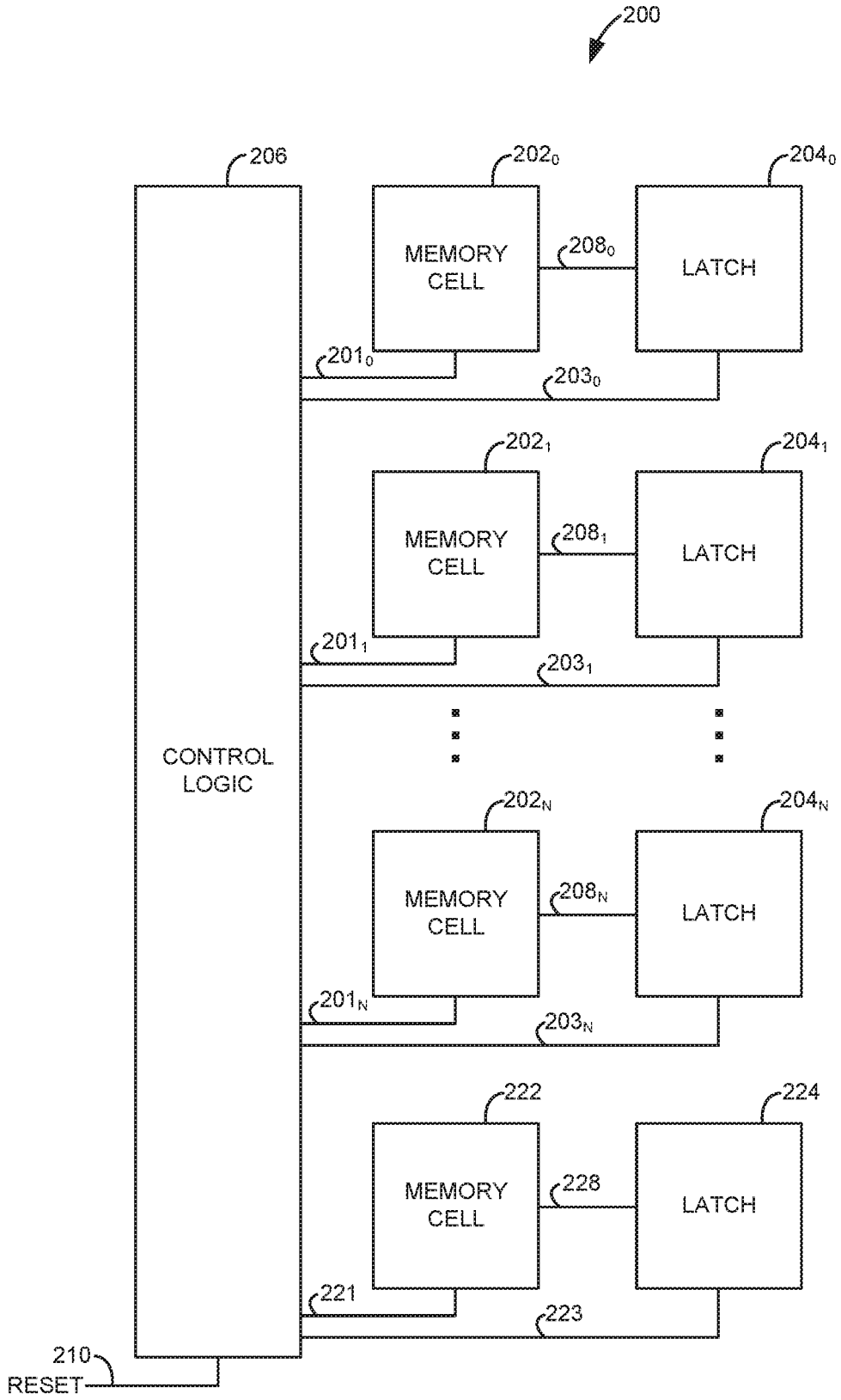
FIG. 2 is a block diagram illustrating another example of an integrated circuit to drive a plurality of fluid actuation devices.

FIG. 2 is a block diagram illustrating another example of an integrated circuit 200 to drive a plurality of fluid actuation devices. Integrated circuit 200 includes a plurality of first memory cells $202_0$ to $202_N$, a plurality of first latches $204_0$ to $204_N$, a second memory cell 222, a second latch 224, and control logic 206. Control logic 206 is electrically coupled to each first memory cell $202_0$ to $202_N$ through a signal path $201_0$ to $201_N$, respectively, to each first latch $204_0$ to $204_N$ through a signal path $203_0$ to $203_N$, respectively, to second memory cell 222 through a signal path 221, to latch 224 through a signal path 223, and to a reset signal path 210. Each first memory cell $202_0$ to $202_N$ is electrically coupled to a corresponding first latch $204_0$ to $204_N$ through a signal path $208_0$ to $208_N$, respectively. The second memory cell 222 is electrically coupled to second latch 224 through a signal path 228.

Each first memory cell $202_0$ to $202_N$ stores a customization bit to configure an operation of the integrated circuit 200. Each first memory cell $202_0$ to $202_N$ includes a non-volatile memory cell (e.g., a floating gate transistor, a programmable fuse, etc.). Each latch $204_0$ to $204_N$ corresponds to a first memory cell $202_0$ to $202_N$, respectively, and outputs a logic signal (i.e., a logic high signal or a logic low signal) that may be directly used by digital logic. The second memory cell 222 stores a lock bit to allow or prevent external access to the plurality of first memory cells $202_0$ to $202_N$. The second memory cell 222 includes a non-volatile memory cell (e.g., a floating gate transistor, a programmable fuse, etc.). The second latch 224 corresponds to the second memory cell 222 and outputs a logic signal (i.e., a logic high signal or a logic low signal) that may be directly used by digital logic. Control logic 206 may include a microprocessor, an application-specific integrated circuit (ASIC), or other suitable logic circuitry for controlling the operation of integrated circuit 200.

Control logic 206, in response to a reset signal on reset signal path 210, reads (e.g., in response to a first edge of the reset signal) the lock bit stored in the second memory cell 222 and latches (e.g., in response to a second edge of the reset signal) the lock bit in the second latch 224. Also in response to the reset signal, control logic 206 reads (e.g., in response to the first edge of the reset signal) the customization bit stored in each first memory cell $202_0$ to $202_N$ and latches (e.g., in response to the second edge of the reset signal) each customization bit in the corresponding first latch $204_0$ to $204_N$. In one example, the control logic 206 allows or prevents external access to the first memory cells $202_0$ to $202_N$ and the second memory cell 222 based on the lock bit.

Figure 3A:
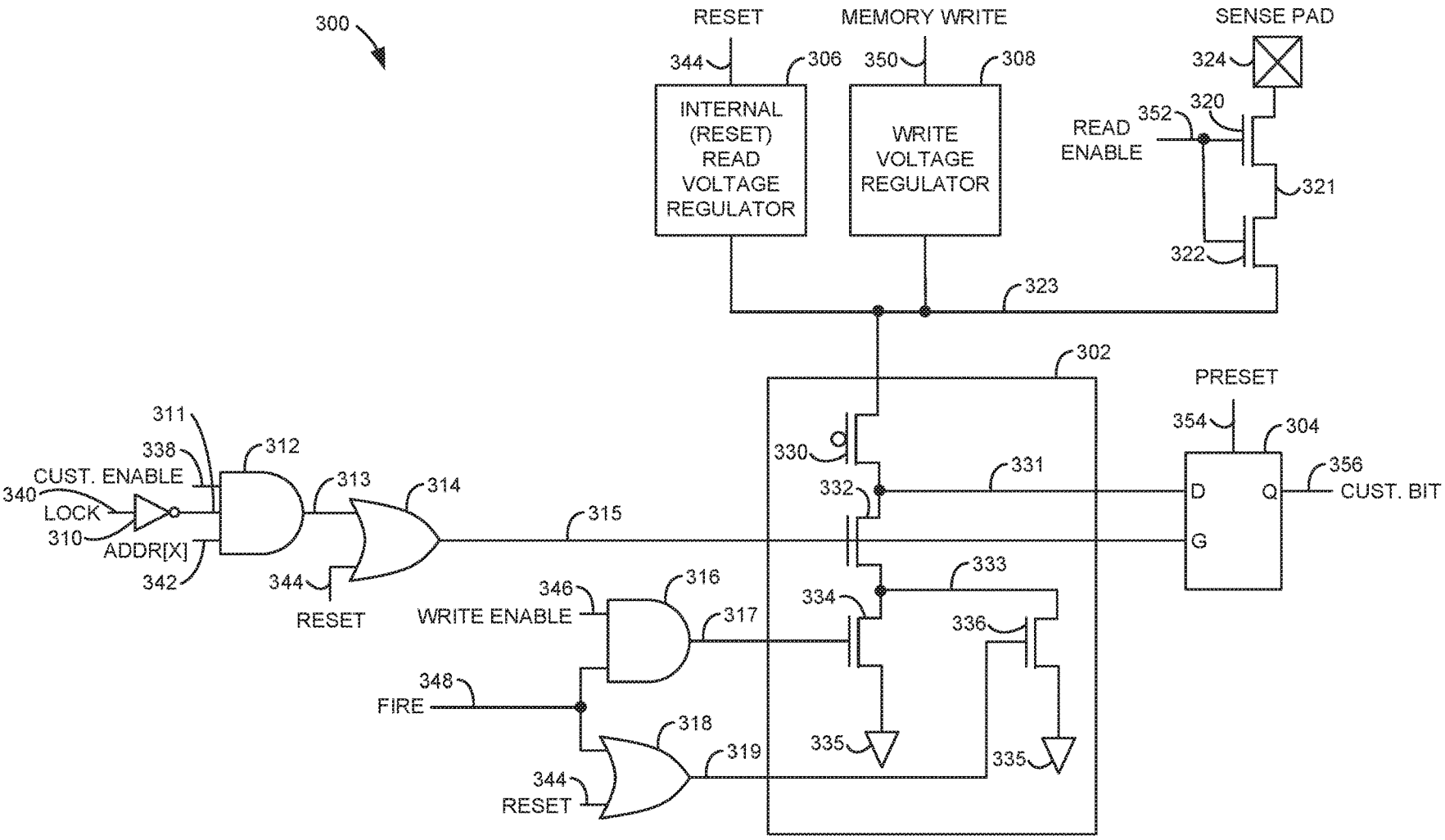
FIG. 3A is a schematic diagram illustrating one example of a circuit for accessing a memory cell storing a customization bit.

FIG. 3A is a schematic diagram illustrating one example of a circuit 300 for accessing a memory cell storing a customization bit. In one example, circuit 300 is part of integrated circuit 100 of FIG. 1A, integrated circuit 120 of FIG. 1B, or integrated circuit 200 of FIG. 2. Circuit 300 includes a memory cell 302, a latch 304, an internal (reset) read voltage regulator 306, a write voltage regulator 308, an inverter 310, AND gates 312 and 316, OR gates 314 and 318, transistors 320 and 322, and a sense pad 324. Memory cell 302 includes a floating gate transistor 330 and transistors 332, 334, and 336.

The input of inverter 310 is electrically coupled to a lock signal path 340. The output of inverter 310 is electrically coupled to a first input of AND gate 312 through a signal path 311. A second input of AND gate 312 is electrically coupled to a customization bit enable signal path 338. A third input of AND gate 312 is electrically coupled to a select signal (ADDR[X], which corresponds to one of Y address bits from a nozzle data stream, where "Y" is any suitable number of bits (e.g., 4)) path 342. The output of AND gate 312 is electrically coupled to a first input of OR gate 314 through a signal path 313. A second input of OR gate 314 is electrically coupled to a reset signal path 344. The output of OR gate 314 is electrically coupled to the gate of transistor 332 of memory cell 302 and the gate (G) input of latch 304 through a signal path 315.

A first input of AND gate 316 is electrically coupled to a write enable signal path 346. A second input of AND gate 316 is electrically coupled to a fire signal path 348. The output of AND gate 316 is electrically coupled to the gate of transistor 334 of memory cell 302 through a signal path 317. A first input of OR gate 318 is electrically coupled to the fire signal path 348. A second input of OR gate 318 is electrically coupled to the reset signal path 344. The output of OR gate 318 is electrically coupled to the gate of transistor 336 of memory cell 302 through a signal path 319.

An input of internal (reset) read voltage regulator 306 is electrically coupled to the reset signal path 344. An output of internal (reset) read voltage regulator 306 is electrically coupled to one side of the source-drain path of floating gate transistor 330 of memory cell 302 through a signal path 323. An input of write voltage regulator 308 is electrically coupled to a memory write signal path 350. An output of write voltage regulator 308 is electrically coupled to one side of the source-drain path of floating gate transistor 330 of memory cell 302 through signal path 323. Sense pad 324 is electrically coupled to one side of the source-drain path of transistor 320. The gate of transistor 320 and the gate of transistor 322 are electrically coupled to a read enable signal path 352. The other side of the source-drain path of transistor 320 is electrically coupled to one side of the source-drain path of transistor 322 through a signal path 321. The other side of the source-drain path of transistor 322 is electrically coupled to one side of the source-drain path of floating gate transistor 330 of memory cell 302 through signal path 323.

The other side of the source-drain path of floating gate transistor 330 is electrically coupled to one side of the source-drain path of transistor 332 and the data (D) input of latch 304 through a signal path 331. Another input of latch 304 is electrically coupled to a preset signal path 354. The output (Q) of latch 304 is electrically coupled to a customization bit signal path 356. The other side of the source-drain path of transistor 332 is electrically coupled to one side of the source-drain path of transistor 334 and one side of the source-drain path of transistor 336 through a signal path 333. The other side of the source-drain path of transistor 334 is electrically coupled to a common or ground node 335. The other side of the source-drain path of transistor 336 is electrically coupled to a common or ground node 335.

While circuit 300 includes one memory cell 302 for storing a customization bit and one corresponding latch 304, circuit 300 may include any suitable number of memory cells 302 and corresponding latches 304 for storing a desired number of customization bits. For each customization bit, each memory cell and corresponding latch would be accessed in a similar manner as described for memory cell 302 and latch 304.

Circuit 300 receives a customization enable signal on customization enable signal path 338, a lock signal on lock signal path 340, an address or select signal on select signal path 342, a reset signal on reset signal path 344, a write enable signal on write enable signal path 346, a fire signal on fire signal path 348, a memory write signal on memory write signal path 350, a read enable signal on read enable signal path 352, and a preset signal on preset signal path 354. The preset signal may be used to override latch 304 during testing to output a desired logic level from latch 304. The customization enable signal and the lock signal may be used to enable or disable write access and external read access to the memory cells storing customization bits. The address signal may be used to select one of the memory cells storing a customization bit. The customization enable signal, the write enable signal, the memory write signal, the read enable signal, and the preset signal may be based on data stored in a configuration register (not shown) or based on data received from a host print apparatus. The lock signal is an internal signal output from a latch, such as latch 224 of FIG. 2.

The address signal is received from a host print apparatus, such as through a data interface. The reset signal may be received from a host print apparatus through a reset interface. The fire signal may be received from a host print apparatus through a fire interface. Each of the data interface, the reset interface, and the fire interface may include a contact pad, a pin, a bump, a wire, or another suitable electrical interface for transmitting signals to and/or from circuit 300. Each of the data interface, the reset interface, the fire interface, and the sense pad 324 may be electrically coupled to a fluid ejection system (e.g., a host print apparatus such as fluid ejection system 600 of FIG. 6).

Inverter 310 receives the lock signal and outputs an inverted lock signal on signal path 311. In response to a logic high customization enable signal, a logic high inverted lock signal, and a logic high select signal, AND gate 312 outputs a logic high signal on signal path 313. In response to a logic low customization enable signal, a logic low inverted lock signal, or a logic low select signal, AND gate 312 outputs a logic low signal on signal path 313.

In response to a logic high signal on signal path 313 or a logic high reset signal, OR gate 314 outputs a logic high signal on signal path 315. In response to a logic low signal on signal path 313 and a logic low reset signal, OR gate 314 outputs a logic low signal on signal path 315. In response to a logic high write enable signal and a logic high fire signal, AND gate 316 outputs a logic high signal on signal path 317. In response to a logic low write enable signal or a logic low fire signal, AND gate 316 outputs a logic low signal on signal path 317. In response to a logic high fire signal or a logic high reset signal, OR gate 318 outputs a logic high signal on signal path 319. In response to a logic low fire signal and a logic low reset signal, OR gate 318 outputs a logic low signal on signal path 319.

In response to a logic high signal on signal path 315, transistor 332 is turned on (i.e., conducting) to enable access to memory cell 302. In response to a logic low signal on signal path 315, transistor 332 is turned off to disable access to memory cell 302. In response to a logic high signal on signal path 317, transistor 334 is turned on to enable write access to memory cell 302. In response to a logic low signal on signal path 317, transistor 334 is turned off to disable write access to memory cell 302. In response to a logic high signal on signal path 319, transistor 336 is turned on to enable read access to memory cell 302. In response to a logic low signal on signal path 319, transistor 336 is turned off to disable read access to memory cell 302. In one example, transistor 334 is a stronger device and transistor 336 is a weaker device. Therefore, the stronger device may be used to enable write access and the weaker device may be used to enable read access to improve the margin for latching the voltage on signal path 331.

In response to a logic high reset signal, internal (reset) read voltage regulator 306 is enabled to output a read voltage bias to signal path 323. In response to logic low reset signal, internal (reset) read voltage regulator 306 is disabled. Accordingly, in response to the reset signal transitioning from a logic low to a logic high, transistors 332 and 336 turn on and internal (reset) read voltage regulator 306 is enabled to read the state (i.e., resistance representing the stored customization bit) of floating gate transistor 330. The state of floating gate transistor 330 is passed to the data (D) input of latch 304 (i.e., as a voltage representing the stored customization bit). In response to the reset signal transitioning from logic high to logic low, the customization bit stored in floating gate transistor 330 is latched by latch 304, transistors 332 and 336 turn off, and the internal (reset) read voltage regulator 306 is disabled. As a result, the customization bit is then available on the output (Q) of latch 304 and therefore on customization bit signal path 356 for use in other digital logic.

In response to a logic high read enable signal, transistors 320 and 322 are turned on to enable external access to memory cell 302 through sense pad 324. In response to a logic low read enable signal, transistors 320 and 322 are turned off to disable external access to memory cell 302 through sense pad 324. Accordingly, in response to a logic high customization enable signal, a logic low lock signal, a logic high address signal, a logic high read enable signal, and a logic high fire signal, transistors 320, 322, 332 and 336 are turned on to allow floating gate transistor 330 to be read through sense pad 324 by an external circuit.

In response to a logic high memory write signal, write voltage regulator 308 is enabled to apply a write voltage to signal path 323. In response to a logic low memory write signal, write voltage regulator 308 is disabled. Accordingly, in response to a logic high customization enable signal, a logic low lock signal, a logic high address signal, a logic high write enable signal, a logic high memory write signal, and a logic high fire signal, transistors 332, 334, and 336 are turned on to allow floating gate transistor 330 to be written by write voltage regulator 308.

Figure 3B:
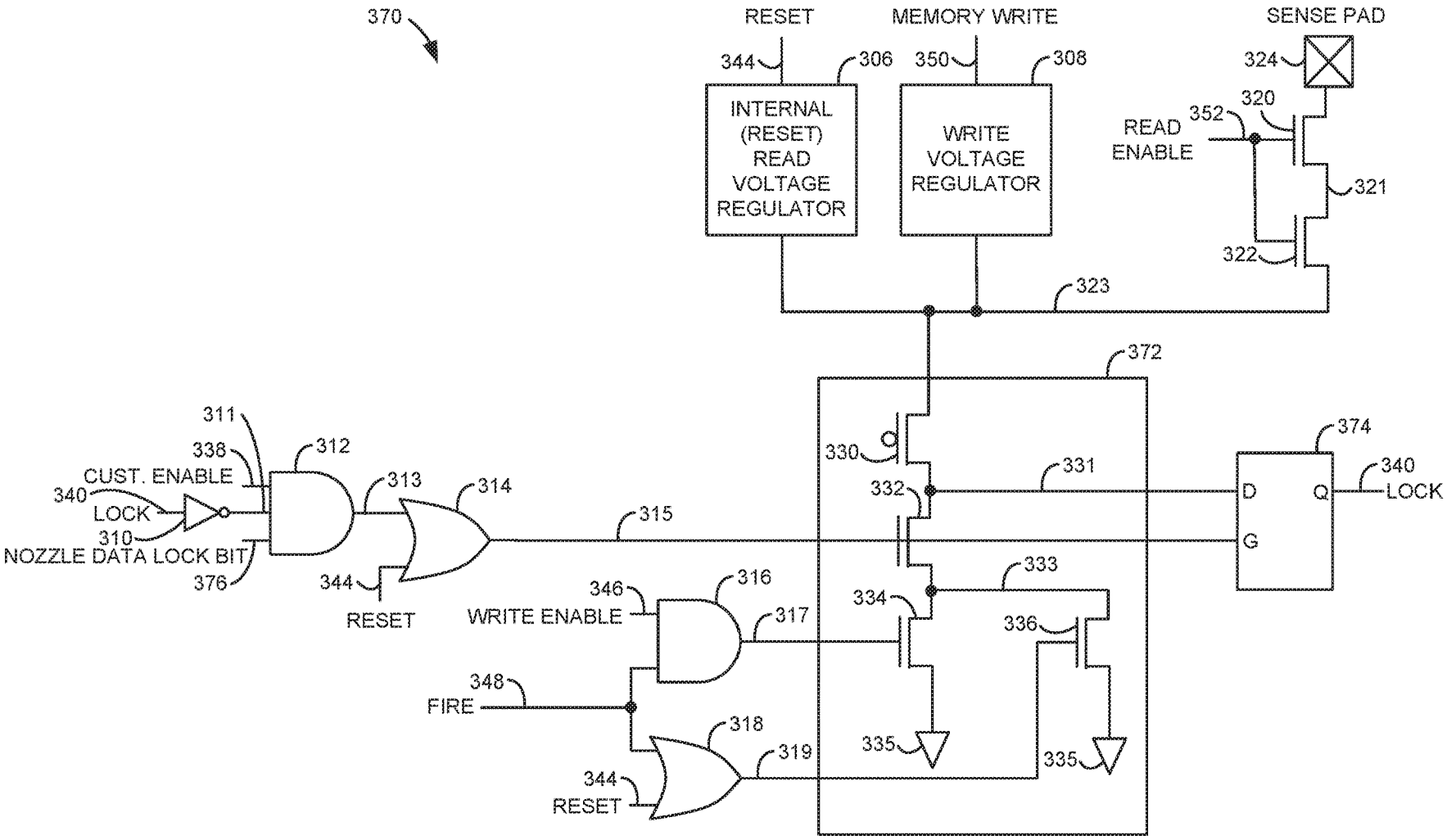
FIG. 3B is a schematic diagram illustrating one example of a circuit for accessing a memory cell storing a lock bit.

FIG. 3B is a schematic diagram illustrating one example of a circuit 370 for accessing a memory cell storing a lock bit. In one example, circuit 370 is part of integrated circuit 120 of FIG. 1B or integrated circuit 200 of FIG. 2. Circuit 370 is similar to circuit 300 previously described and illustrated with reference to FIG. 3A, except that in circuit 370, memory cell 302 is replaced with a memory cell 372 and latch 304 is replaced with a latch 374. Memory cell 372 stores a lock bit and latch 374 latches the lock bit in response to the reset signal.

Memory cell 372 is similar to memory cell 302 previously described. Latch 374 is similar to latch 304 previously described, except that latch 374 does not include a preset signal input. The output (Q) of latch 374 provides the lock signal on lock signal path 340, which is an input to inverter 310 (see also inverter 310 of FIG. 3A). In place of a select signal input to AND gate 312, a nozzle data lock bit signal is input to AND gate 312 through a nozzle data lock bit signal path 376. The nozzle data lock bit signal may be used to select memory cell 372. The nozzle data lock bit signal may be based on data received from a host print apparatus, such as through a data interface. Memory cell 372 may be enabled for write or read access similarly to memory cell 302 of FIG. 3A as previously described.

Figure 4A:
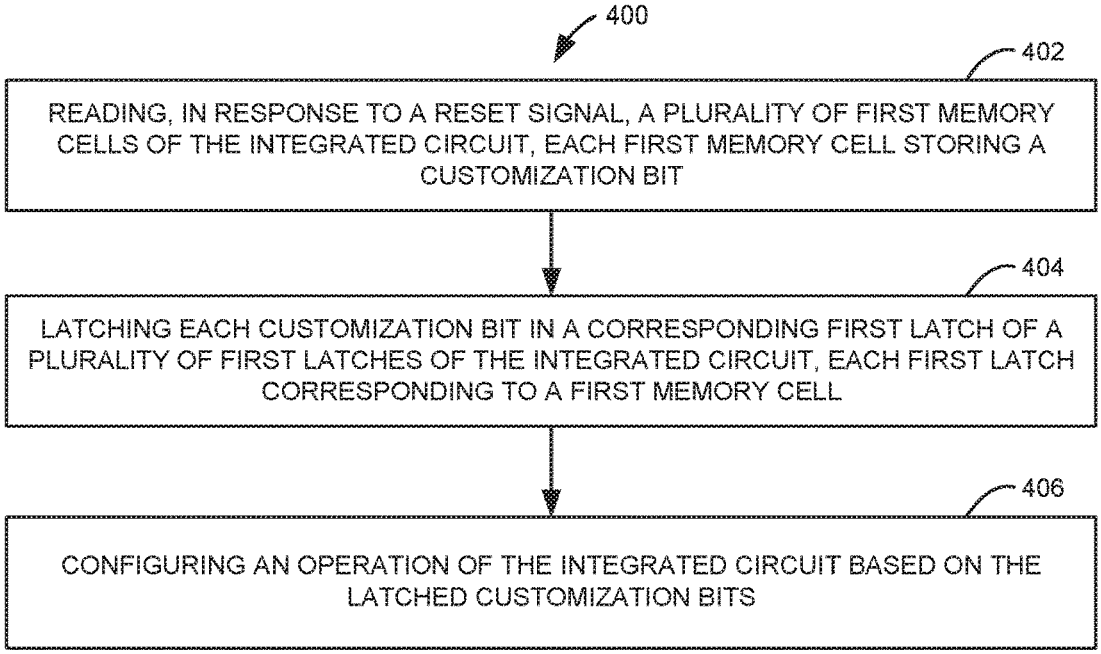
FIGS. 4A-4C are flow diagrams illustrating examples of a method for resetting an integrated circuit to drive a plurality of fluid actuation devices.
Figure 4B:
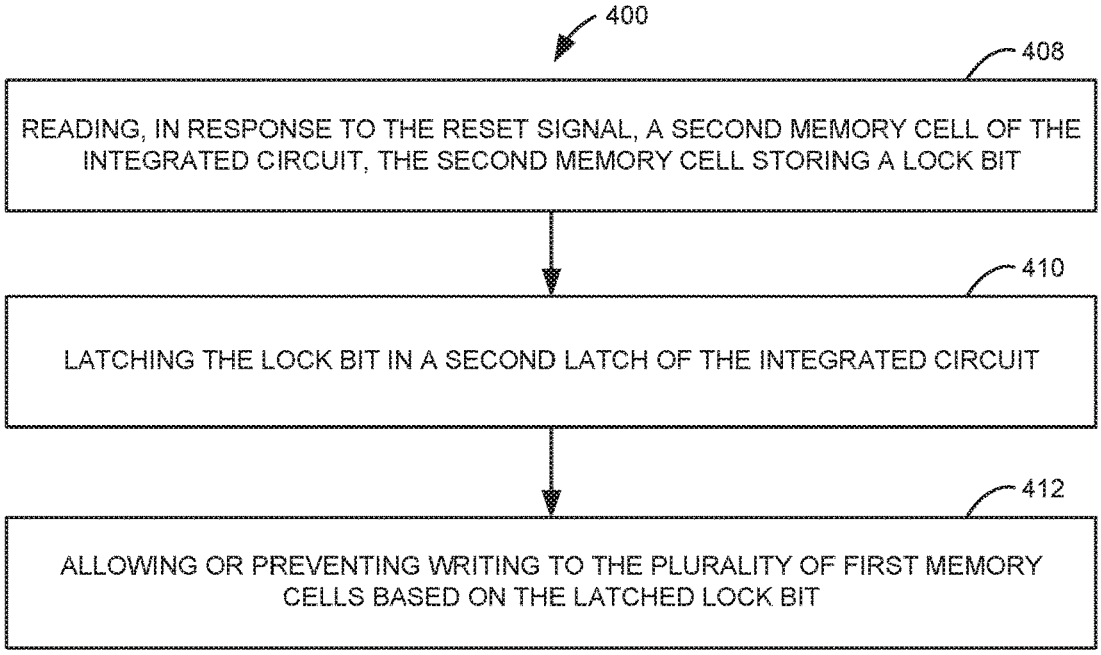
Figure 4C:
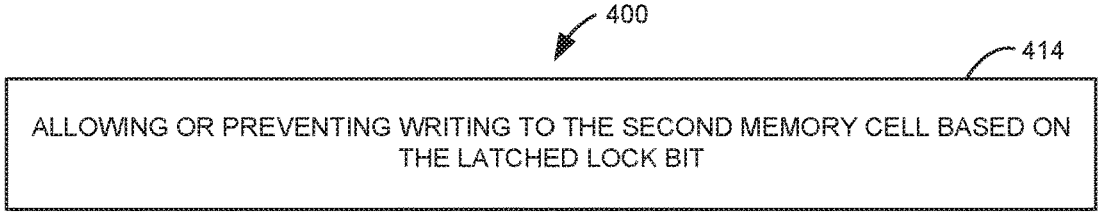

FIGS. 4A-4C are flow diagrams illustrating examples of a method 400 for resetting an integrated circuit to drive a plurality of fluid actuation devices. In one example, method 400 may be implemented by integrated circuit 100 of FIG. 1A, integrated circuit 120 of FIG. 1B, integrated circuit 200 of FIG. 2, circuit 300 of FIG. 3A, and/or circuit 370 of FIG. 3B. As illustrated in FIG. 4A, at 402 method 400 includes reading, in response to a reset signal, a plurality of first memory cells of the integrated circuit, each first memory cell storing a customization bit. At 404, method 400 includes latching each customization bit in a corresponding first latch of a plurality of first latches of the integrated circuit, each first latch corresponding to a first memory cell. At 406, method 400 includes configuring an operation of the integrated circuit based on the latched customization bits. In one example, configuring the operation of the integrated circuit may include modifying an address input to the integrated circuit based on the latched customization bits.

As illustrated in FIG. 4B, at 408 method 400 may further include reading, in response to the reset signal, a second memory cell of the integrated circuit, the second memory cell storing a lock bit. At 410, method 400 may further include latching the lock bit in a second latch of the integrated circuit. At 412, method 400 may further include allowing or preventing writing to the plurality of first memory cells based on the latched lock bit. As illustrated in FIG. 4C, at 414 method 400 may further include allowing or preventing writing to the second memory cell based on the latched lock bit. External reading may also be allowed or prevented based on the latched lock bit.

Figure 5A:
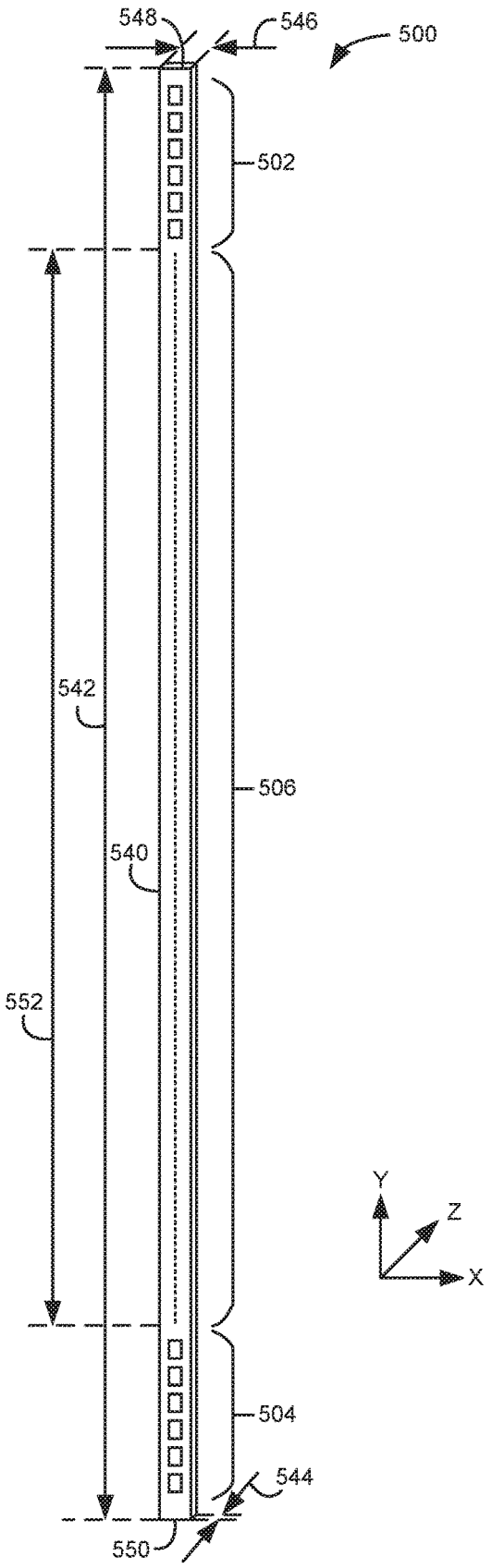
FIGS. 5A and 5B illustrate one example of a fluid ejection die.
Figure 5B:
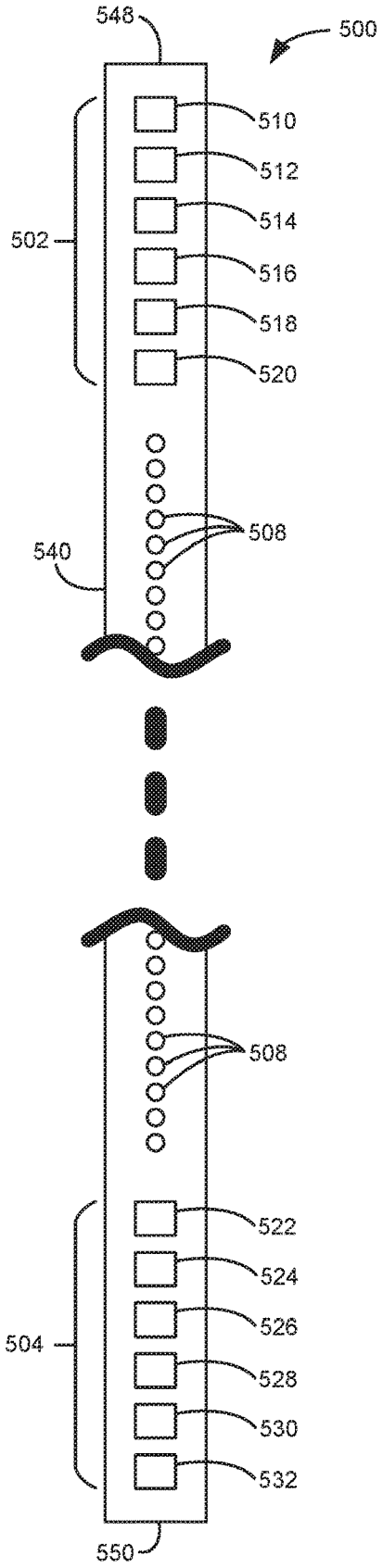

FIG. 5A illustrates one example of a fluid ejection die 500 and FIG. 5B illustrates an enlarged view of the ends of fluid ejection die 500. In one example, fluid ejection die 500 includes integrated circuit 100 of FIG. 1A, integrated circuit 120 of FIG. 1B, integrated circuit 200 of FIG. 2, circuit 300 of FIG. 3A, and/or circuit 370 of FIG. 3B. Die 500 includes a first column 502 of contact pads, a second column 504 of contact pads, and a column 506 of fluid actuation devices 508.

The second column 504 of contact pads is aligned with the first column 502 of contact pads and at a distance (i.e., along the Y axis) from the first column 502 of contact pads. The column 506 of fluid actuation devices 508 is disposed longitudinally to the first column 502 of contact pads and the second column 504 of contact pads. The column 506 of fluid actuation devices 508 is also arranged between the first column 502 of contact pads and the second column 504 of contact pads. In one example, fluid actuation devices 508 are nozzles or fluidic pumps to eject fluid drops.

In one example, the first column 502 of contact pads includes six contact pads. The first column 502 of contact pads may include the following contact pads in order: a data contact pad 510, a clock contact pad 512, a logic power ground return contact pad 514, a multipurpose input/output contact (e.g., sense) pad 516, a first high voltage power supply contact pad 518, and a first high voltage power ground return contact pad 520. Therefore, the first column 502 of contact pads includes the data contact pad 510 at the top of the first column 502, the first high voltage power ground return contact pad 520 at the bottom of the first column 502, and the first high voltage power supply contact pad 518 directly above the first high voltage power ground return contact pad 520. While contact pads 510, 512, 514, 516, 518, and 520 are illustrated in a particular order, in other examples the contact pads may be arranged in a different order.

In one example, the second column 504 of contact pads includes six contact pads. The second column 504 of contact pads may include the following contact pads in order: a second high voltage power ground return contact pad 522, a second high voltage power supply contact pad 524, a logic reset contact pad 526, a logic power supply contact pad 528, a mode contact pad 530, and a fire contact pad 532. Therefore, the second column 504 of contact pads includes the second high voltage power ground return contact pad 522 at the top of the second column 504, the second high voltage power supply contact pad 524 directly below the second high voltage power ground return contact pad 522, and the fire contact pad 532 at the bottom of the second column 504. While contact pads 522, 524, 526, 528, 530, and 532 are illustrated in a particular order, in other examples the contact pads may be arranged in a different order.

Data contact pad 510 may be used to input serial data to die 500 for selecting fluid actuation devices, memory bits, thermal sensors, configuration modes (e.g. via a configuration register), etc. Data contact pad 510 may also be used to output serial data from die 500 for reading memory bits, configuration modes, status information (e.g., via a status register), etc. Clock contact pad 512 may be used to input a clock signal to die 500 to shift serial data on data contact pad 510 into the die or to shift serial data out of the die to data contact pad 510. Logic power ground return contact pad 514 provides a ground return path for logic power (e.g., about 0 V) supplied to die 500. In one example, logic power ground return contact pad 514 is electrically coupled to the semiconductor (e.g., silicon) substrate 540 of die 500. Multipurpose input/output contact pad 516 may be used for analog sensing and/or digital test modes of die 500. In one example, multipurpose input/output contact (e.g., sense) pad 516 may provide sense interface 136 of FIG. 1B or sense pad 324 of FIGS. 3A and 3B.

First high voltage power supply contact pad 518 and second high voltage power supply contact pad 524 may be used to supply high voltage (e.g., about 32 V) to die 500. First high voltage power ground return contact pad 520 and second high voltage power ground return contact pad 522 may be used to provide a power ground return (e.g., about 0 V) for the high voltage power supply. The high voltage power ground return contact pads 520 and 522 are not directly electrically connected to the semiconductor substrate 540 of die 500. The specific contact pad order with the high voltage power supply contact pads 518 and 524 and the high voltage power ground return contact pads 520 and 522 as the innermost contact pads may improve power delivery to die 500. Having the high voltage power ground return contact pads 520 and 522 at the bottom of the first column 502 and at the top of the second column 504, respectively, may improve reliability for manufacturing and may improve ink shorts protection.

Logic reset contact pad 526 may be used as a logic reset input to control the operating state of die 500. In one example, logic reset contact pad 526 may be electrically coupled to reset signal path 110 of FIGS. 1A and 1B, reset signal path 210 of FIG. 2, or reset signal path 344 of FIGS. 3A and 3B. Logic power supply contact pad 528 may be used to supply logic power (e.g., between about 1.8 V and 15 V, such as 5.6 V) to die 500. Mode contact pad 530 may be used as a logic input to control access to enable/disable configuration modes (i.e., functional modes) of die 500. Fire contact pad 532 may be used as a logic input to latch loaded data from data contact pad 510 and to enable fluid actuation devices or memory elements of die 500. In one example, fire contact pad 532 may be electrically coupled to fire signal path 348 of FIGS. 3A and 3B.

Die 500 includes an elongate substrate 540 having a length 542 (along the Y axis), a thickness 544 (along the Z axis), and a width 546 (along the X axis). In one example, the length 542 is at least twenty times the width 546. The width 546 may be 1 mm or less and the thickness 544 may be less than 500 microns. The fluid actuation devices 508 (e.g., fluid actuation logic) and contact pads 510-532 are provided on the elongate substrate 540 and are arranged along the length 542 of the elongate substrate. Fluid actuation devices 508 have a swath length 552 less than the length 542 of the elongate substrate 540. In one example, the swath length 552 is at least 1.2 cm. The contact pads 510-532 may be electrically coupled to the fluid actuation logic. The first column 502 of contact pads may be arranged near a first longitudinal end 548 of the elongate substrate 540. The second column 504 of contact pads may be arranged near a second longitudinal end 550 of the elongate substrate 540 opposite to the first longitudinal end 548.

Figure 6:
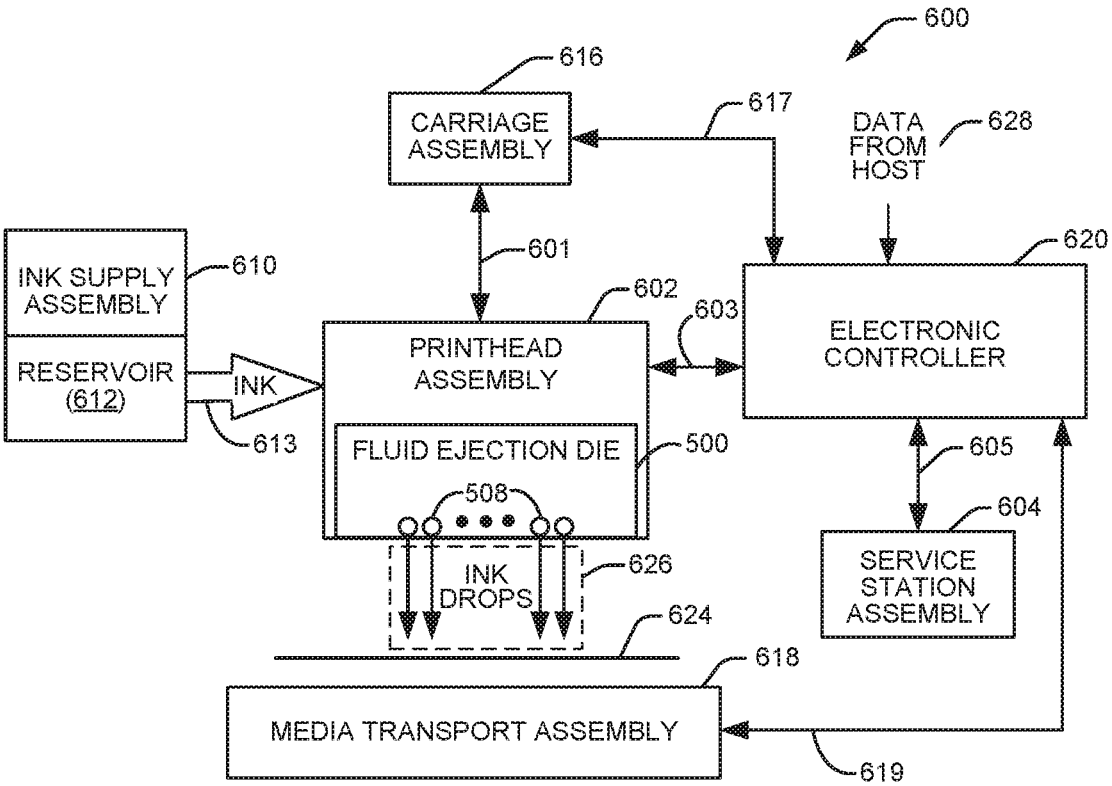
FIG. 6 is a block diagram illustrating one example of a fluid ejection system.

FIG. 6 is a block diagram illustrating one example of a fluid ejection system 600. Fluid ejection system 600 includes a fluid ejection assembly, such as printhead assembly 602, and a fluid supply assembly, such as ink supply assembly 610. In the illustrated example, fluid ejection system 600 also includes a service station assembly 604, a carriage assembly 616, a print media transport assembly 618, and an electronic controller 620. While the following description provides examples of systems and assemblies for fluid handling with regard to ink, the disclosed systems and assemblies are also applicable to the handling of fluids other than ink.

Printhead assembly 602 includes at least one printhead or fluid ejection die 500 previously described and illustrated with reference to FIGS. 5A and 5B, which ejects drops of ink or fluid through a plurality of orifices or nozzles 508. In one example, the drops are directed toward a medium, such as print media 624, so as to print onto print media 624. In one example, print media 624 includes any type of suitable sheet material, such as paper, card stock, transparencies, Mylar, fabric, and the like. In another example, print media 624 includes media for three-dimensional (3D) printing, such as a powder bed, or media for bioprinting and/or drug discovery testing, such as a reservoir or container. In one example, nozzles 508 are arranged in at least one column or array such that properly sequenced ejection of ink from nozzles 508 causes characters, symbols, and/or other graphics or images to be printed upon print media 624 as printhead assembly 602 and print media 624 are moved relative to each other.

Ink supply assembly 610 supplies ink to printhead assembly 602 and includes a reservoir 612 for storing ink. As such, in one example, ink flows from reservoir 612 to printhead assembly 602. In one example, printhead assembly 602 and ink supply assembly 610 are housed together in an inkjet or fluid-jet print cartridge or pen. In another example, ink supply assembly 610 is separate from printhead assembly 602 and supplies ink to printhead assembly 602 through an interface connection 613, such as a supply tube and/or valve.

Carriage assembly 616 positions printhead assembly 602 relative to print media transport assembly 618, and print media transport assembly 618 positions print media 624 relative to printhead assembly 602. Thus, a print zone 626 is defined adjacent to nozzles 508 in an area between printhead assembly 602 and print media 624. In one example, printhead assembly 602 is a scanning type printhead assembly such that carriage assembly 616 moves printhead assembly 602 relative to print media transport assembly 618. In another example, printhead assembly 602 is a non-scanning type printhead assembly such that carriage assembly 616 fixes printhead assembly 602 at a prescribed position relative to print media transport assembly 618.

Service station assembly 604 provides for spitting, wiping, capping, and/or priming of printhead assembly 602 to maintain the functionality of printhead assembly 602 and, more specifically, nozzles 508. For example, service station assembly 604 may include a rubber blade or wiper which is periodically passed over printhead assembly 602 to wipe and clean nozzles 508 of excess ink. In addition, service station assembly 604 may include a cap that covers printhead assembly 602 to protect nozzles 508 from drying out during periods of non-use. In addition, service station assembly 604 may include a spittoon into which printhead assembly 602 ejects ink during spits to ensure that reservoir 612 maintains an appropriate level of pressure and fluidity, and to ensure that nozzles 508 do not clog or weep. Functions of service station assembly 604 may include relative motion between service station assembly 604 and printhead assembly 602.

Electronic controller 620 communicates with printhead assembly 602 through a communication path 603, service station assembly 604 through a communication path 605, carriage assembly 616 through a communication path 617, and print media transport assembly 618 through a communication path 619. In one example, when printhead assembly 602 is mounted in carriage assembly 616, electronic controller 620 and printhead assembly 602 may communicate via carriage assembly 616 through a communication path 601. Electronic controller 620 may also communicate with ink supply assembly 610 such that, in one implementation, a new (or used) ink supply may be detected.

Electronic controller 620 receives data 628 from a host system, such as a computer, and may include memory for temporarily storing data 628. Data 628 may be sent to fluid ejection system 600 along an electronic, infrared, optical or other information transfer path. Data 628 represent, for example, a document and/or file to be printed. As such, data 628 form a print job for fluid ejection system 600 and includes at least one print job command and/or command parameter.

In one example, electronic controller 620 provides control of printhead assembly 602 including timing control for ejection of ink drops from nozzles 508. As such, electronic controller 620 defines a pattern of ejected ink drops which form characters, symbols, and/or other graphics or images on print media 624. Timing control and, therefore, the pattern of ejected ink drops, is determined by the print job commands and/or command parameters. In one example, logic and drive circuitry forming a portion of electronic controller 620 is located on printhead assembly 602. In another example, logic and drive circuitry forming a portion of electronic controller 620 is located off printhead assembly 602.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. An integrated circuit to drive a plurality of fluid actuation devices, the integrated circuit comprising:
- a plurality of first memory cells, each first memory cell storing a customization bit;
- a plurality of first storage elements, each first storage element coupled to a corresponding first memory cell; and
- control logic to, in response to a reset signal, read the customization bit stored in each first memory cell and latch each customization bit in a corresponding first storage element,
- a second memory cell storing a lock bit; and
- a second storage element coupled to the second memory cell,
- wherein the control logic is to, in response to the reset signal, read the lock bit stored in the second memory cell and latch the lock bit in the second storage element, and
- wherein the control logic is to allow or prevent writing to the plurality of first memory cells based on the latched lock bit.

2. The integrated circuit of claim 1, wherein the control logic is to configure an operation of the integrated circuit based on the latched customization bits.

3. The integrated circuit of claim 2, wherein the operation is to modify an address input to the integrated circuit based on the latched customization bits.

4. The integrated circuit of claim 1, wherein the control logic is to allow or prevent writing to the second memory cell based on the latched lock bit.

5. The integrated circuit of claim 1, wherein the second storage element comprises a second latch.

6. The integrated circuit of claim 1, further comprising:
- a single interface coupled to each of the plurality of first memory cells.

7. The integrated circuit of claim 6, further comprising:
- a write circuit coupled to the single interface, the write circuit to write the customization bit to each of the plurality of first memory cells through the single interface.

8. The integrated circuit of claim 6, further comprising:
- a read circuit coupled to the single interface, the read circuit to enable external access to read the customization bit of each of the plurality of first memory cells through the single interface.

9. The integrated circuit of claim 1, wherein the first storage element comprises a first latch.

10. An integrated circuit to drive a plurality of fluid actuation devices, the integrated circuit comprising:
- a plurality of first memory cells, each first memory cell storing a customization bit to configure an operation of the integrated circuit;
- a plurality of first latches, each first latch corresponding to a first memory cell;
- a second memory cell storing a lock bit to allow or prevent external access to the plurality of first memory cells;
- a second latch corresponding to the second memory cell; and control logic to, in response to a reset signal, read the lock bit stored in the second memory cell and latch the lock bit in the second latch, and read the customization bit stored in each first memory cell and latch each customization bit in a corresponding first latch.

11. The integrated circuit of claim 10, wherein the control logic is to allow or prevent external access to the first memory cells and the second memory cell based on the lock bit.

12. The integrated circuit of claim 10, wherein each first memory cell comprises a non-volatile memory cell and the second memory cell comprises a non-volatile memory cell.

13. A method for resetting an integrated circuit to drive a plurality of fluid actuation devices, the method comprising:

reading, in response to a reset signal, a plurality of first memory cells of the integrated circuit, each first memory cell storing a customization bit;

latching each customization bit in a corresponding first latch of a plurality of first latches of the integrated circuit, each first latch corresponding to a first memory cell;

configuring an operation of the integrated circuit based on the latched customization bits;

reading, in response to the reset signal, a second memory cell of the integrated circuit, the second memory cell storing a lock bit;

latching the lock bit in a second latch of the integrated circuit; and allowing or preventing writing to the plurality of first memory cells based on the latched lock bit.

14. The method of claim 13, further comprising:

allowing or preventing writing to the second memory cell based on the latched lock bit.

15. The method of claim 13, wherein configuring the operation of the integrated circuit comprises modifying an address input to the integrated circuit based on the latched customization bits.

* * * * *